US011846210B2

(12) United States Patent
Lou et al.

(10) Patent No.: US 11,846,210 B2
(45) Date of Patent: Dec. 19, 2023

(54) SYSTEM AND METHOD FOR MAINTAINING ELECTRICAL POWER CONTINUITY IN A STEAM-BASED POWER PLANT

(71) Applicant: General Electric Company, Schenectady, NY (US)

(72) Inventors: Xinsheng Lou, Windsor, CT (US); Stanley Kmiotek, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/757,200

(22) PCT Filed: Dec. 7, 2020

(86) PCT No.: PCT/US2020/063563

§ 371 (c)(1),
(2) Date: Jun. 10, 2022

(87) PCT Pub. No.: WO2021/126571

PCT Pub. Date: Jun. 24, 2021

(65) Prior Publication Data

US 2023/0003144 A1 Jan. 5, 2023

Related U.S. Application Data

(60) Provisional application No. 62/948,589, filed on Dec. 16, 2019.

(51) Int. Cl.
*F01K 13/00* (2006.01)
*F01K 13/02* (2006.01)

(52) U.S. Cl.
CPC ..... *F01K 13/006* (2013.01); *F01K 13/02* (2013.01)

(58) Field of Classification Search
CPC ..... F01K 13/006; F01K 13/02; F01K 3/22
See application file for complete search history.

(56) References Cited

U.S. PATENT DOCUMENTS 10,326,305 B1 6/2019 Jelinek
2009/0272028 A1* 11/2009 Drozd ..... C10L 5/14 44/550

(Continued)

FOREIGN PATENT DOCUMENTS

WO 2014/174373 A2 10/2014

*Primary Examiner* — Matthew T Largi
(74) *Attorney, Agent, or Firm* — Grogan, Tuccillo & Vanderleeden, LLP

(57) ABSTRACT

A system for maintaining electrical power continuity in a steam-based power plant is provided. The system includes a fossil fuel-fired power generation unit and an electrical power storage apparatus. The fossil fuel-fired power generation unit is operative to generate and provide electrical power to an electrical power grid. The electrical power storage apparatus is electrically coupled to the fossil fuel-fired power generation unit and operative to: receive and store electrical power from the fossil fuel-fired power generation unit during periods of surplus electrical power generation by the fossil fuel-fired power generation unit; and to provide electrical power to a component of the fossil fuel-fired power generation unit during periods of electrical power shortage by the electrical power grid.

20 Claims, 4 Drawing Sheets

(56) References Cited

U.S. PATENT DOCUMENTS

| | | | | |
|---|---|---|---|---|
| 2010/0023174 | A1* | 1/2010 | Nagata | H02J 3/003 700/287 |
| 2011/0082598 | A1* | 4/2011 | Boretto | H02J 3/381 700/297 |
| 2012/0046798 | A1 | 2/2012 | Orthlieb et al. | |
| 2012/0323396 | A1* | 12/2012 | Shelton | H02M 7/44 700/297 |
| 2013/0122433 | A1* | 5/2013 | Labbe | F23N 5/00 431/12 |
| 2015/0028675 | A1* | 1/2015 | Scheurlen | H02J 3/30 307/45 |
| 2016/0233679 | A1* | 8/2016 | Li | F03D 9/255 |
| 2019/0311442 | A1* | 10/2019 | Helsel | G06Q 10/06312 |
| 2020/0191117 | A1* | 6/2020 | Li | F03D 7/046 |

* cited by examiner

SYSTEM AND METHOD FOR MAINTAINING ELECTRICAL POWER CONTINUITY IN A STEAM-BASED POWER PLANT

TECHNICAL FIELD

Embodiments of the present disclosure relate generally to a fossil fuel-fired, steam-based electrical power plant and, more specifically, to a system and method for maintaining electrical power continuity in a steam-based power plant.

BACKGROUND

Many steam-based power plants generate electrical power via a steam-turbine driven by steam produced from the combustion of fossil fuels, e.g., coal. Such steam-based power plants are often connected to electrical grids, e.g., wide area distribution networks for electrical power often including multiple power plants. Typically, a steam-based power plant burning coal uses electrical power from the grid to which it is connected to drive various elements, e.g., fuel feeders, fuel-pulverizers, heaters, water pumps, air fans, etc., that facilitate electrical power generation operations.

Many electrical power grids, however, often suffer from fluctuations in their ability to supply consistent electrical power. For example, a grid may experience periods where demand exceeds supply due to natural and/or man-made events and/or accidents. In such scenarios, the frequency of the electrical power supplied by the grid may drop by as much as 0.5 Hz or more. As will be understood, such fluctuations may damage the various elements within a steam-based power plant and/or restrict/hamper normal electrical power generation operations.

What is needed, therefore, is an improved system and method for maintaining electrical power continuity in a steam-based power plant.

BRIEF DESCRIPTION

In an embodiment, a system for maintaining electrical power continuity in a steam-based power plant is provided. The system includes a fossil fuel-fired power generation unit and an electrical power storage apparatus. The fossil fuel-fired power generation unit is operative to generate and provide electrical power to an electrical power grid. The electrical power storage apparatus is electrically coupled to the fossil fuel-fired power generation unit and operative to: receive and store electrical power from the fossil fuel-fired power generation unit during periods of surplus electrical power generation by the fossil fuel-fired power generation unit; and to provide electrical power to a component of the fossil fuel-fired power generation unit during periods of electrical power shortages by the electrical power grid.

In another embodiment, a method for maintaining electrical power continuity in a steam-based power plant is provided. The method includes receiving, at an electrical power storage apparatus, surplus electrical power from a fossil fuel-fired power generation unit electrically coupled to an electrical power grid and to the electrical power storage apparatus. The method further includes storing the surplus electrical power in the electrical power storage apparatus. The method further includes providing the stored surplus electrical power by the electrical power storage apparatus to a component of the fossil fuel-fired power generation unit during a period of electrical power shortage by the electrical power grid.

In yet another embodiment, a non-transitory computer readable medium storing instructions is provided. The stored instructions adapt a processor to: direct an electrical power storage apparatus to receive surplus electrical power from a fossil fuel-fired power generation unit electrically coupled to an electrical power grid and to the electrical power storage apparatus; direct the electrical power storage apparatus to store the surplus electrical power in the electrical power storage apparatus; and direct the electrical power storage apparatus to provide the stored surplus electrical power to a component of the fossil fuel-fired power generation unit during a period of electrical power shortage by the electrical power grid.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
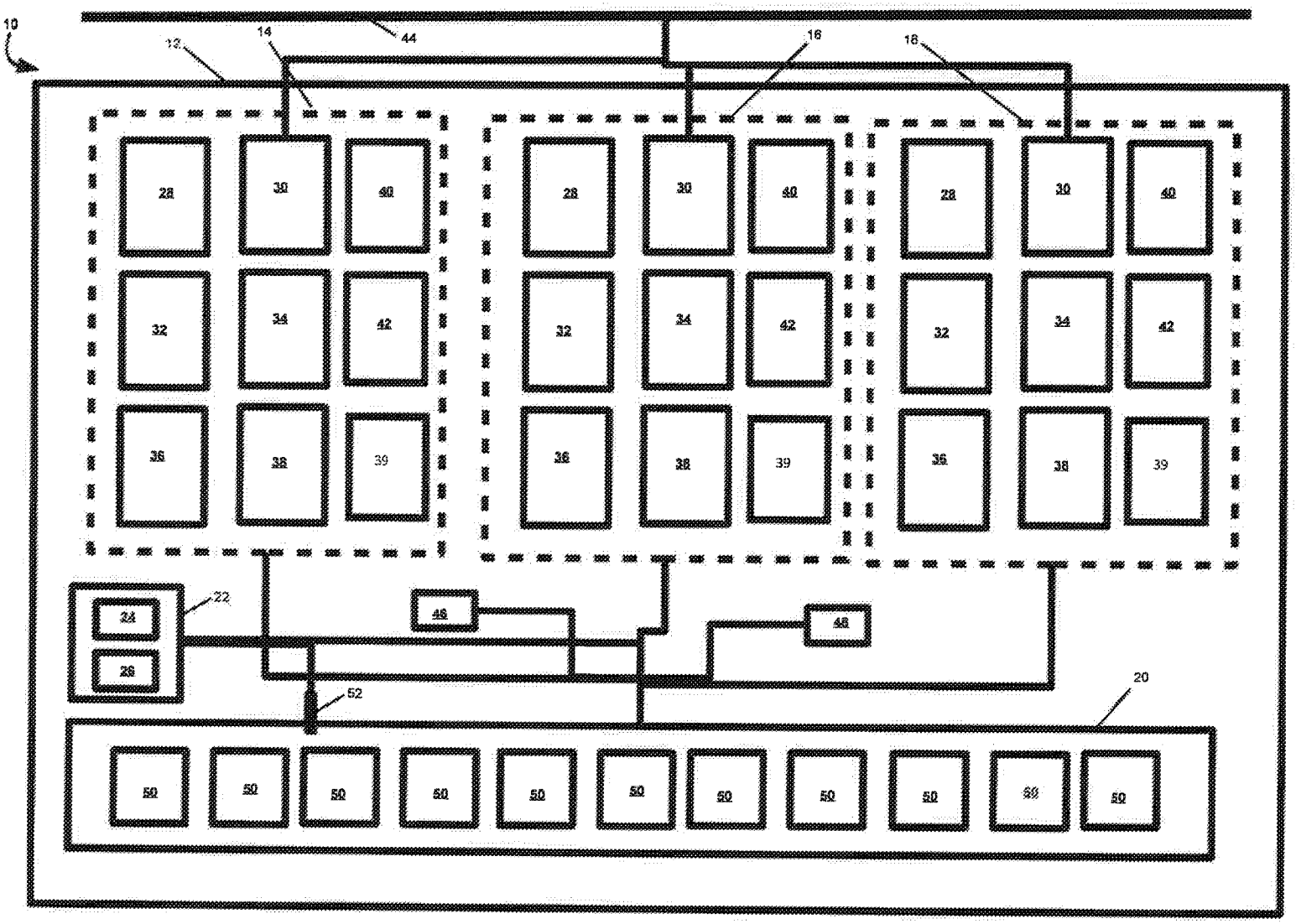
FIG. 1 is a schematic diagram of a system for maintaining electrical power continuity in a steam-based power plant, in accordance with an embodiment of the present disclosure.

Reference will be made below in detail to exemplary embodiments of the present system for maintaining electrical power continuity in a steam-based power plant, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. As also used herein, the term "heating contact" means that the referenced objects are in proximity of one another such that heat/thermal energy can transfer between them. As used herein, "electrically coupled," "electrically connected," and "electrical communication" mean that the referenced elements are directly or indirectly connected such that an electrical current, or other communication medium, may flow from one to the other. The connection may include a direct conductive connection (i.e., without an intervening capacitive, inductive or active element), an inductive connection, a capacitive connection, and/or any other suitable electrical connection. Intervening components may be present. The term "real-time", as used herein, means a level of processing responsiveness that a user senses as sufficiently immediate or that enables the processor to keep up with an external process. As used herein, the term "steam-based power plant" refers to a building or facility housing one or more fossil fuel-fired power generation units. As also used herein, a "fossil fuel-fired power generation unit" refers to a collection of equipment, which includes a turbine generator, for generating electrical power.

Additionally, while the embodiments disclosed herein are primarily described with respect to a steam-based power plant, it is to be understood that embodiments of the present disclosure may be applicable to other types of power plants and/or systems that rely on or benefit from uninterrupted and/or consistent electrical power.

Referring now to FIG. 1, a system 10 for maintaining electrical power continuity in a steam-based power plant 12 is shown in accordance with an embodiment of the present disclosure. The system 10 includes one or more fossil fuel-fired (e.g., coal-fired) power generation units 14, 16 and 18 and an electrical power storage apparatus/device 20. In embodiments, the system 10 may further include a controller 22 having at least one processor 24 and a memory device 26. As will be explained in greater detail below, the electrical power storage unit 20 is operative to: receive and store electrical power from the one or more fossil fuel-fired power generation units 14, 16 and 18; and to provide electrical power to one or more components 28, 30, 32, 34, 36, 38, 39, 40 and/or 42 of the power generation units 14, 16 and 18 during periods of electrical power shortages by an electrical power grid 44 to which the power plant 12 is electrically connected to.

As shown in FIG. 1, each of the fossil fuel-fired power generation units 14, 16 and 18 may include a boiler 28, a steam turbine 30, a pulverizer 32, a classifier 34 (which may be incorporated into the pulverizer 32), a fan 36, a water pump 38, a heater 40, a plasma igniter 42 (disposed within a firing chamber or fuel conduit of a boiler or furnace and often requiring on the order of 100-200 kW) and/or other devices utilized in the production of steam and/or electricity. Moreover, each of the fossil fuel-fired power generation units 14, 16 and 18 may additionally include an air pollution control system or environmental control system (ECS) 39 for gas cleaning (e.g., for removing NOx, SOx, Hg, particulate matter, etc.). While FIG. 1 depicts the power plant 12 as having three (3) fossil fuel-fired power generation units 14, 16 and 18, it will be understood that other embodiments may include a single fossil fuel-fired power generation unit, two (2) fossil fuel-fired power generation units, and/or more than three (3) fossil fuel-fired power generation units.

The electrical power storage apparatus 20, which may be disposed in the power plant 12, is electrically connected to each of the fossil fuel-fired power generation units 14, 16 and 18. It will be understood, however, that, in other embodiments, the electrical power storage apparatus 20 may be disposed outside the plant 12. In embodiments, the electrical power storage apparatus 20 may be further connected to additional components, e.g., converters, inverters, transformers, pumps 46, conveyors 48, etc., that are apart from and/or shared by the fossil fuel-fired power generation units 14, 16 and 18. In embodiments, the electrical power storage apparatus 20 may include one or more batteries 50 connected in parallel or in series. The batteries 50 may be chemical acid based and/or rare-earth metal based, e.g., lithium ion.

As will be appreciated, the electrical power storage apparatus 20 may be directly connected, i.e., without passing electrical power indirectly through the grid 44, to the steam turbines 30 (or their corresponding generator) so that the batteries 50 are directly chargeable via the electrical power produced by the plant 12. As will be further appreciated, in embodiments, the electrical storage apparatus 20 may be connected to and/or charged by the electrical grid 44. In embodiments, the batteries 50 may be electrically connected to the power generation units 14, 16 and 18 via electric power converters, transformers and/or other substation devices.

In embodiments, the system 10 may further include one or more sensors 52 operative to provide sensory information about the electrical power storage apparatus 20 to the controller 22. In embodiments, the sensory information may include data about: the voltage levels of the batteries 50; the discharge rate of the batteries 50; the charging rate of the batteries 50; the temperature of the batteries 50; time periods during with the batteries 50 are charging and/or discharging; and/or other information concerning the batteries 50 and/or other components of the power storage apparatus 20.

Figure 2:
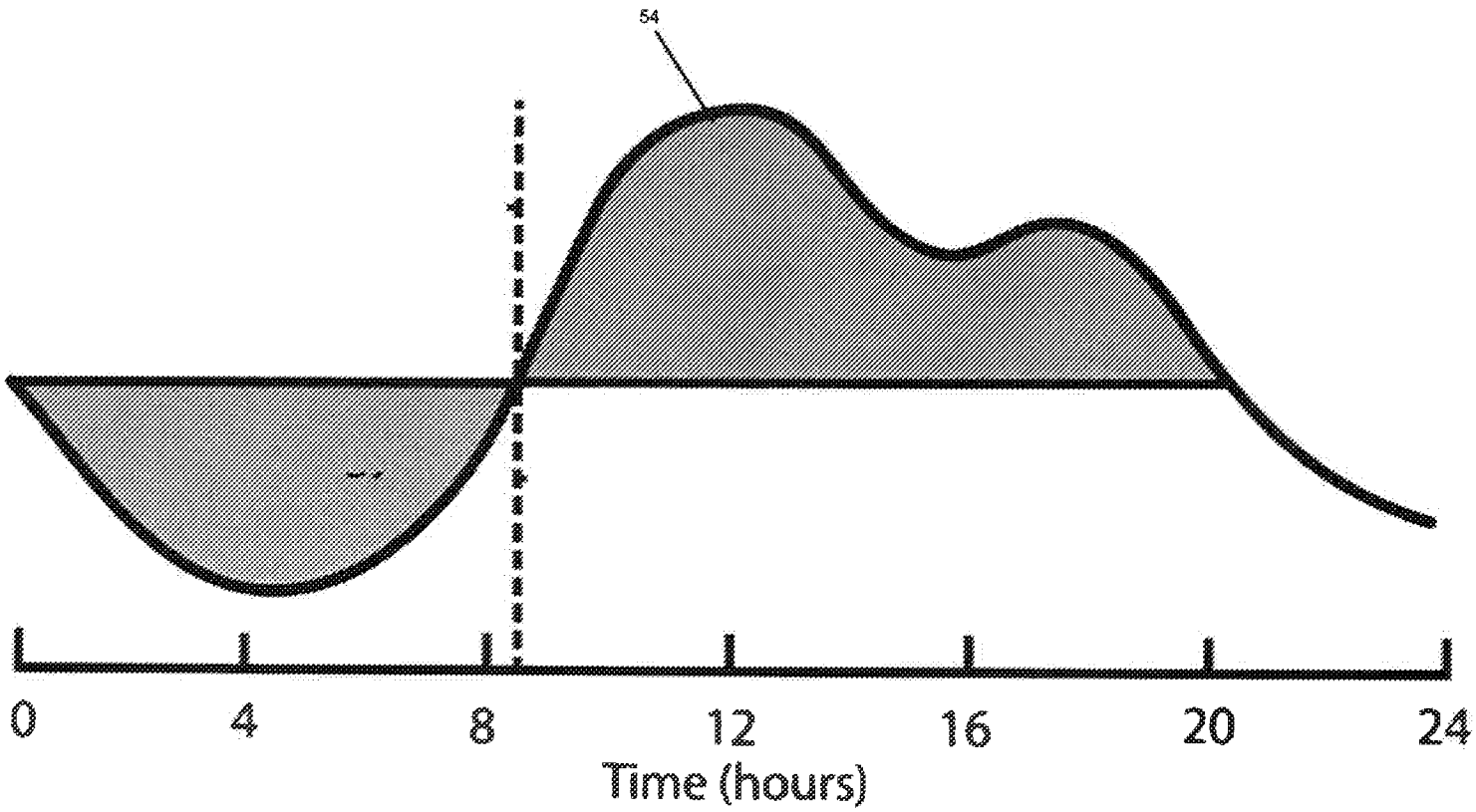
FIG. 2 is a diagram depicting the charging and discharging of an electrical power storage apparatus of the system of FIG. 1, in accordance with an embodiment of the present disclosure.

Turning to FIG. 2, a chart depicting a possible generalized scenario of electrical power flux to and from the electrical power storage apparatus 20 is shown, i.e., the charging and discharging of the electrical power storage apparatus 20. As can be seen, at t=0, the amount of charge (represented by line 54) is zero (0). The period between t=0 to t≈9, to the left of the dashed line, represents a scenario where the power plant 12 and/or the fossil fuel-fired power generation units 14, 16 and/or 18 are generating more electrical power than is being demanded by the grid 44, i.e., a period of low power demand and surplus electrical power generation, with the excess electrical power serving to charge the electrical power storage apparatus 20. The shaded region to the left of the dashed lines indicates energy storage by the power storage apparatus 20. The period between t=9 to t≈24 represents a scenario where the grid 44 cannot provide a sufficient flow of electrical power to the fossil fuel-fired power generation units 14, 16 and/or 18, i.e., a period of high power demand where the grid 44 is experiencing a shortage, and, thus, the electrical power storage apparatus 20 discharges/provides the previously stored electrical power to the fossil fuel-fired power generation units 14, 16 and/or 18. The shaded region to the right of the dashed lines indicates energy release by the power storage apparatus 20. In other words, the electrical power storage apparatus 20 supplements or replaces the electrical power previously supplied by the grid 44 to the fossil fuel-fired power generation units 14, 16 and/or 18 which, in turn, allows the fossil fuel-fired power generation units 14, 16 and/or 18 to continue to operate so as to generate electrical power for the grid 44, thereby maintaining electrical power continuity by the plant 12 and/or the fossil fuel-fired power generation units 14, 16 and/or 18.

Figure 3:
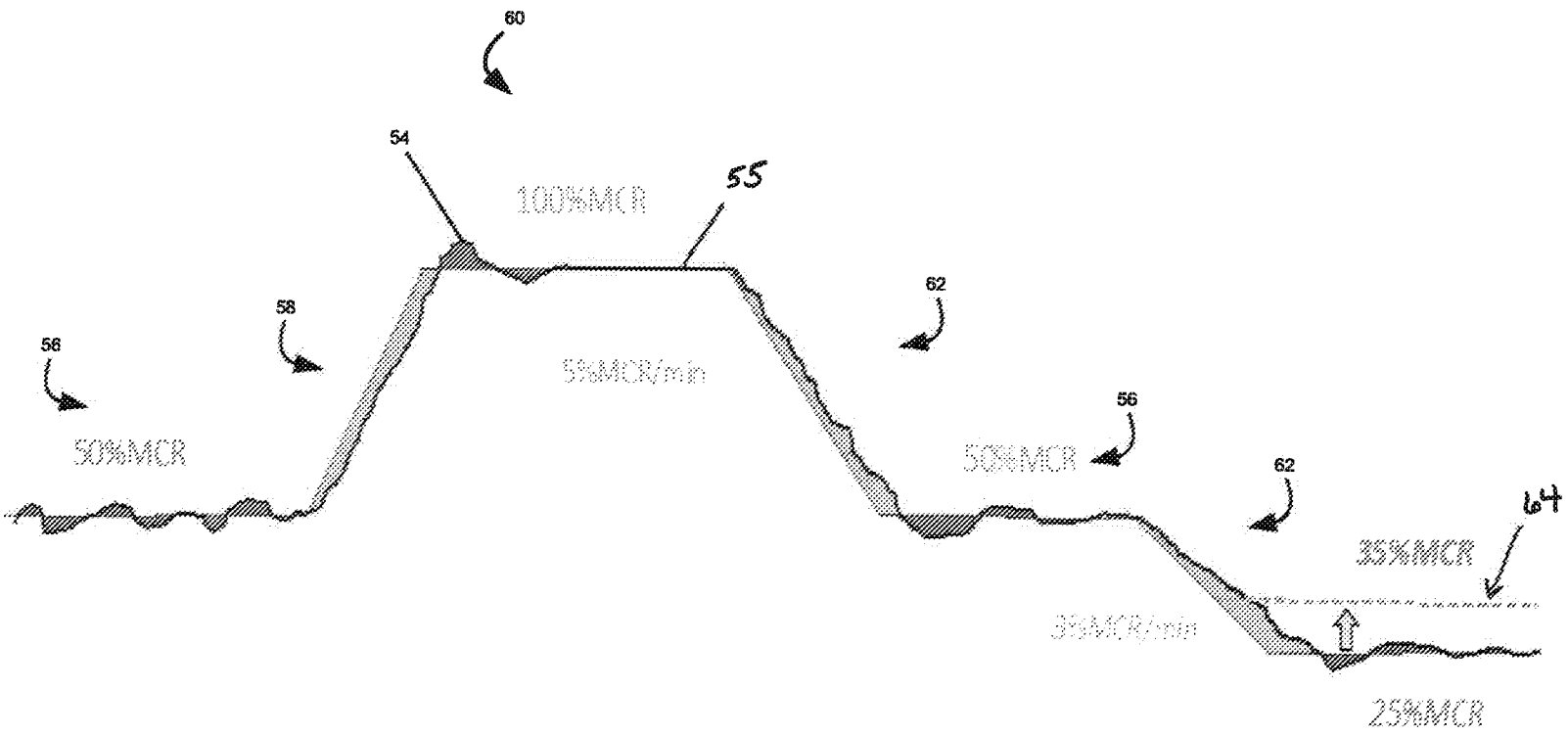
FIG. 3 is another diagram depicting the charging and discharging of an electrical power storage apparatus of the system of FIG. 1, in accordance with an embodiment of the present disclosure.

Illustrated in FIG. 3 is another chart depicting a possible generalized scenario of the electrical power flux to and from the electrical power storage apparatus 20 over the course of a changing maximum continuous rating ("MCR") of the plant 12. As will be appreciated, the electrical power storage apparatus 20 may charge (indicated as the area above the curve of line 54 with respect to line 55) and/or discharge (indicated as the area below the curve 54 with respect to line 55) as the plant 12 and/or fossil fuel-fired power generation units 14, 16 and 18: operate at 50% MCR (shown generally by arrows 56); ramp up (shown generally by arrow 58); operate at 100% MCR (shown generally by arrow 60); ramp down (shown generally by arrows 62); and operate at 35% MCR or lower (shown generally by arrow 64) (or even 25% MCR or lower).

Returning back to FIG. 1, in embodiments, an artificial intelligence application may be stored in the memory device 26 and loaded into the processor 24 with the purpose of monitoring the electrical power flux to and from the electrical power storage apparatus 20. In some embodiments, the artificial intelligence application may include a neural network that receives its inputs from the one or more sensors 52. In embodiments, the artificial intelligence application may provide for management of the electrical power storage apparatus 20, e.g., rationing of the available stored electrical power to the various power generation units 14, 16, 18 and/or the components within. In some embodiments, the artificial intelligence application may manage the electrical power storage apparatus 20 to maximize the availability of the electrical power storage apparatus 20 to charge (i.e., store electrical power/energy). The artificial intelligence application may also monitor the status and/or performance of DC/AC and/or AC/DC conversion modules within the plant 12 and/or monitor and/or regulate the temperature of one or more components of the plant 12 and/or power generation units 14, 16 and 18. In some embodiments, the artificial intelligence application may include machine learning capabilities (e.g., machine learning modules may be included).

As will be understood, the capacity and/or the density of batteries 50 are often limited. Thus, scheduling and/or real-time control of battery 50 operations may provide for improved reliability of the electrical power storage apparatus 20. Accordingly, in embodiments, the artificial intelligence application may provide for life monitoring of the electrical power storage apparatus 20, i.e., the artificial intelligence application may determine that (or predict when) the electrical power storage apparatus 20 is not able to efficiently charge and/or discharge. In embodiments, the artificial intelligence application may regulate the distribution of stored electrical power from the electrical power storage apparatus 20 to the power generation units 14, 16 and 18 and/or the components within to compensate for load controls in order to smooth the load on each of the power generation units 14, 16 and 18. In embodiments, the artificial intelligence application may provide or schedule predictive and/or preventative maintenance for the batteries 50. In embodiments, the artificial intelligence application may provide advice for maintenance and/or part replacement for the electrical power storage unit 20.

For example, in embodiments, the artificial intelligence application may employ a mathematic model-based dynamic optimization approach such as:

Maximize Profit($t$)=Revenue from serving grid (capacity revenue, spinning reserve, . . . )−(SPS generation cost+battery charge cost+battery discharge cost)

Subject to:

a) Rate of charge or discharge (Battery density);
b) Capacity availability;
c) Steam power generation capacity;
d) Steam power auxiliary equipment power consumption rates;
e) Lowest load of the steam power generation unit(s);
f) Limits from DC/AC and AC/DC conversion systems;
g) Limits from steam power generation unit startup time;
h) Process dynamic models (to be discretized as proper); and/or
i) Other suitable constraints.

In embodiments, the artificial intelligence application may incorporate advanced model-based estimations, detection and/or control methods/subsystems, which may provide for enhanced flexibility over traditional electrical power backup systems, e.g., gas generators. For example, in embodiments, the artificial intelligence application may be operative to retrieve operating data and/or commands from a conventional distributed control system ("DCS") and/or an integrated controls system. In such embodiments, the artificial intelligence application may process real-time (and/or historic) data with predefined analysis modules to generate new operating guidelines and/or operating configurations. In embodiments, the artificial intelligence application may summarize the operating experiences of the plant 12, e.g., successes and/or failures, and publish un-structured data, e.g., new knowledge gleaned from the electrical power storage apparatus 20 via the neural network, for use as source data by other artificial intelligence systems, e.g., Big Data for "Stacked Benefits" in an integrated local and/or regional grid.

Figure 4:
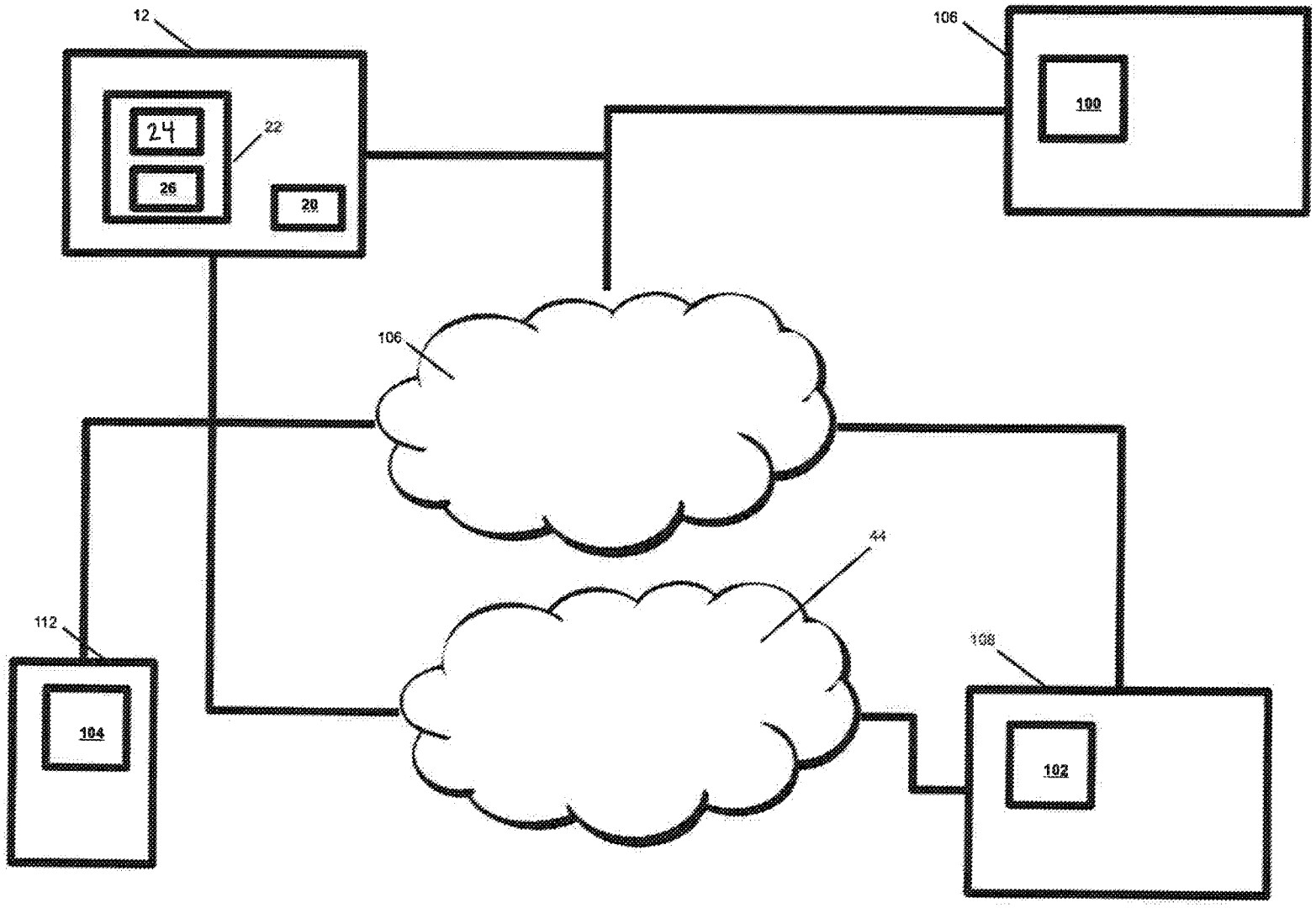
FIG. 4 is a diagram depicting a network utilized by a controller of the system of FIG. 1, in accordance with an embodiment of the present disclosure.

Moving now to FIG. 4, in embodiments, the artificial intelligence application may be operative to electrically communicate with at least one other processor 100, 102, 104 disposed outside of the same plant 12 in which the electrical power storage apparatus 20 is disposed. For example, the artificial intelligence application may electrically communicate over a network 106 with a database and/or data center 106, another power plant 108, and/or another type of facility 112 that may handle, process and/or otherwise benefit from the data collected by the sensors 52 and/or the predictions by the artificial intelligence application. In an embodiment, the artificial intelligence application software is configured to support the operation of the integrated steam power generation system 10 with battery energy storage systems.

Finally, it is also to be understood that the system 10 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein. For example, the system 10 may include at least one processor (e.g., processor 24) and system memory/data storage structures (e.g., memory 26), which may include random access memory (RAM) and read-only memory (ROM). The at least one processor of the system 10 may include one or more conventional microprocessors and one or more supplementary co-processors such as math co-processors or the like. The data storage structures discussed herein may include an appropriate combination of magnetic, optical, and/or semiconductor memory and may include, for example, RAM, ROM, flash drive, an optical disc (such as a compact disc), and/or a hard disk or drive.

Additionally, a software application that adapts the controller, i.e., at least one processor, to perform the methods disclosed herein may be read into a main memory of the at least one processor from a computer-readable medium. The term "computer-readable medium", as used herein, refers to any medium that provides or participates in providing instructions to the at least one processor of the system 10 (or any other processor of a device described herein) for execution. Such a medium may take many forms, including, but not limited to, non-volatile media and volatile media. Non-volatile media include, for example, optical, magnetic, or opto-magnetic disks, such as memory. Volatile media include dynamic random-access memory ("DRAM"), which typically constitutes the main memory. Common forms of computer-readable media include, for example, a floppy disk, a flexible disk, a hard disk, magnetic tape, any other magnetic medium, a CD-ROM, a DVD, any other optical medium, a RAM, a PROM, an EPROM or EEPROM (electronically erasable programmable read-only memory), a FLASH-EEPROM, any other memory chip or cartridge, or any other medium which a computer can read.

While, in embodiments, the execution of sequences of instructions in the software application causes at least one processor to perform the methods/processes described herein, hard-wired circuitry may be used in place of, or in combination with, software instructions for implementation of the methods/processes of the present disclosure. Therefore, embodiments of the present disclosure are not limited to any specific combination of hardware and/or software.

It is further to be understood that the above description is intended to be illustrative and not restrictive. For example, the above-described embodiments (and/or aspects thereof) may be used in combination with each other. Additionally, many modifications may be made to adapt a particular situation or material to the teachings of the present disclosure without departing from its scope.

For example, in an embodiment, a system for maintaining electrical power continuity in a steam-based power plant is provided. The system includes a fossil fuel-fired power generation unit and an electrical power storage apparatus. The fossil fuel-fired power generation unit is operative to generate and provide electrical power to an electrical power grid. The electrical power storage apparatus is electrically coupled to the fossil fuel-fired power generation unit and operative to: receive and store electrical power from the fossil fuel-fired power generation unit during periods of surplus electrical power generation by the fossil fuel-fired power generation unit; and to provide electrical power to a component of the fossil fuel-fired power generation unit during periods of electrical power shortage by the electrical power grid. In certain embodiments, the electrical power storage apparatus and the fossil fuel-fired power generation unit are disposed within the steam-based power plant. In certain embodiments, the electrical power storage apparatus is electrically coupled to an additional fossil fuel-fired power generation unit. In certain embodiments, the component of the fossil fuel-fired power generation unit is at least one of: a coal pulverizer; a fuel classifier; a fan; a water pump; a heater; and a plasma igniter. In certain embodiments, the periods of electrical power shortage include at least one of: a ramp-up of the fossil fuel-fired power generation unit; a peak-demand period of the fossil fuel-fired power generation unit; and a power fault of the electrical grid.

In certain embodiments, the system further includes a memory device storing an artificial intelligence application; and at least one processor operative to execute the artificial intelligence application. In such embodiments, the artificial intelligence application is operative to: monitor an electrical power flux rate of the electrical power storage apparatus; and predict future periods of surplus electrical power generation by the fossil fuel-fired power generation unit and/or future periods of electrical power shortage by the electrical power grid. In certain embodiments, the artificial intelligence application includes a neural network. In certain embodiments, the artificial intelligence application is further operative to electrically communicate with at least one other processor disposed outside of the same plant in which the electrical power storage apparatus is disposed. In certain embodiments, the electrical power storage apparatus directly provides electrical power to the component of the fossil fuel-fired power generation unit.

Yet another embodiment provides for a method for maintaining electrical power continuity in a steam-based power plant. The method includes receiving, at an electrical power storage apparatus, surplus electrical power from a fossil fuel-fired power generation unit electrically coupled to an electrical power grid and to the electrical power storage apparatus. The method further includes storing the surplus electrical power in the electrical power storage apparatus. The method further includes providing the stored surplus electrical power stored by the electrical power storage apparatus to a component of the fossil fuel-fired power generation unit during a period of electrical power shortage by the electrical power grid.

In certain embodiments, the electrical power storage apparatus and the fossil fuel-fired power generation unit are disposed within the steam-based power plant. In certain embodiments, the electrical power storage apparatus is electrically coupled to an additional fossil fuel-fired power generation unit. In certain embodiments, the component of the fossil fuel-fired power generation unit is at least one of: a coal pulverizer; a fuel classifier; a fan; a water pump; a heater; and a plasma igniter. In certain embodiments, the period of electrical power shortage includes at least one of: a ramp-up of the fossil fuel-fired power generation unit; a peak-demand period of the fossil fuel-fired power generation unit; and a power fault of the electrical grid.

In certain embodiments, the method further includes: monitoring an electrical power flux rate of the electrical power storage apparatus via an artificial intelligence application executing on at least one processor; and predicting, via the artificial intelligence application, future periods of surplus electrical power generation by the fossil fuel-fired power generation unit and/or future periods of electrical power shortage by the electrical power grid. In certain embodiments, the artificial intelligence application includes a neural network. In certain embodiments, the method further includes electrically communicating, via the artificial intelligence application, with at least one other processor disposed outside of the same plant in which the electrical power storage apparatus is disposed. In certain embodiments, the electrical power storage apparatus directly provides electrical power to the component of the fossil fuel-fired power generation unit.

Still yet another embodiment provides for a non-transitory computer readable medium that stores instructions. The stored instructions adapt a processor to direct the electrical power storage apparatus to: receive surplus electrical power from a fossil fuel-fired power generation unit electrically coupled to an electrical power grid and to the electrical power storage apparatus; store the surplus electrical power in the electrical power storage apparatus; and provide the stored surplus electrical power stored by the electrical power storage apparatus to a component of the fossil fuel-fired power generation unit during a period of electrical power shortage by the electrical power grid.

In certain embodiments, the electrical power storage apparatus is disposed within the same steam-based power plant as the fossil fuel-fired power generation unit. In certain embodiments, the electrical power storage apparatus is electrically coupled to an additional fossil fuel-fired power generation unit. In certain embodiments, the component of the fossil fuel-fired power generation unit is at least one of: a coal pulverizer; a fuel classifier; a fan; a water pump; a heater; and a plasma igniter. In certain embodiments, the period of electrical power shortage includes at least one of: a ramp-up of the fossil fuel-fired power generation unit; a peak-demand period of the fossil fuel-fired power generation unit; and a power fault of an electrical grid to which the fossil fuel-fired power generation unit is electrically coupled.

In certain embodiments, the stored instructions further adapt a processor to execute an artificial intelligence application. In such embodiments, the artificial intelligence application is operative to: monitor an electrical power flux rate of the electrical power storage apparatus; and predict future periods of surplus electrical power generation by the fossil fuel-fired power generation unit and/or future periods of electrical power shortage by the electrical power grid. In certain embodiments, the artificial intelligence application includes a neural network. In certain embodiments, the artificial intelligence application is further operative to electrically communicate with at least one other processor disposed outside of the same plant in which the electrical power storage apparatus is disposed. In certain embodiments, the electrical power storage apparatus directly provides electrical power to the component of the fossil fuel-fired power generation unit.

Accordingly, by providing an electrical power storage device at and/or near the location of a fossil fuel-fired power generation unit, some embodiments of the present disclosure may mitigate and/or eliminate electrical power continuity issues resulting from fluctuations in the electrical power provided by the grid to which the fossil fuel-fired power generation unit is connected to.

As will also be appreciated, by providing for an electrical power storage solution, as opposed to a gas powered backup generator, some embodiments of the present disclosure provide for a more environmentally friendly backup power source for a power plant and/or a fossil fuel-fired power generation unit.

Further, some embodiments of the system 10 may provide for the retrofitting of existing power plants and/or fossil fuel-fired power generation units with an electrical power storage device.

Further still, by providing for an energy storage system (the electrical power storage apparatus) that is locally connected to a plant's auxiliary system, electrical power can be discharged from the energy storage system, e.g., batteries, with optimal density and duration to support the operation of local power driven equipment, e.g., pumps, fans/blowers, pulverizers, electric heating and/or cooling elements, etc.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels and are not intended to impose numerical or positional requirements on their objects. Further, the limitations of the following claims are not written in means-plus-function format and are not intended to be interpreted as such, unless and until such limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention without departing from the spirit and scope of the invention herein involved, it is intended that all of the subject matter of the above description shown in the accompanying drawings shall be interpreted merely as examples illustrating the inventive concept herein and shall not be construed as limiting the invention.

The invention claimed is:

1. A system for maintaining electrical power continuity in a steam-based power plant, the system comprising:

a fossil fuel-fired power generation unit operative to generate and provide electrical power to an electrical power grid;

an electrical power storage apparatus electrically coupled to the fossil fuel-fired power generation unit and operative to:

receive and store electrical power from the fossil fuel-fired power generation unit during periods of surplus electrical power generation by the fossil fuel-fired power generation unit; and provide electrical power to a component of the fossil fuel-fired power generation unit during periods of electrical power shortage by the electrical power grid; and a controller including a memory device storing an artificial intelligence application and at least one processor operative to execute the artificial intelligence application, wherein the artificial intelligence application is operative to:

monitor an electrical power flux rate of the electrical power storage apparatus; and manage charging and discharging of the electrical power storage apparatus based on the monitoring of the electrical power flux rate.

2. The system of claim 1, wherein the electrical power storage apparatus and the fossil fuel-fired power generation unit are disposed within the steam-based power plant.

3. The system of claim 1, wherein the electrical power storage apparatus is electrically coupled to an additional fossil fuel-fired power generation unit.

4. The system of claim 1, wherein the component of the fossil fuel-fired power generation unit is at least one of:

a coal pulverizer;

a fuel classifier;

a fan;

a water pump;

a heater; and a plasma igniter.

5. The system of claim 1, wherein the periods of electrical power shortage include at least one of:

a ramp-up of the fossil fuel-fired power generation unit;

a peak-demand period of the fossil fuel-fired power generation unit; and a power fault of the electrical grid.

6. The system of claim 1, wherein the artificial intelligence application is further operative to:

predict future periods of surplus electrical power generation by the fossil fuel-fired power generation unit and/or future periods of electrical power shortages by the electrical power grid.

7. The system of claim 1, wherein the artificial intelligence application includes a neural network.

8. The system of claim 1, wherein the artificial intelligence application is further operative to electrically communicate with at least one other processor disposed outside of the steam-based power plant in which the electrical power storage apparatus is disposed.

9. The system of claim 1, wherein the electrical power storage apparatus directly provides electrical power to the component of the fossil fuel-fired power generation unit.

10. The system of claim 1, wherein the artificial intelligence application is further operative to:

monitor an ability of the electrical power storage apparatus to efficiently charge and/or discharge; and schedule predictive and/or preventative maintenance of the electrical power storage apparatus.

11. A method for maintaining electrical power continuity in a steam-based power plant, the method comprising:

receiving, at an electrical power storage apparatus, surplus electrical power from a fossil fuel-fired power generation unit electrically coupled to an electrical power grid and to the electrical power storage apparatus;

storing the surplus electrical power in the electrical power storage apparatus;

providing the stored surplus electrical power by the electrical power storage apparatus to a component of the fossil fuel-fired power generation unit during a period of electrical power shortage by the electrical power grid;

monitoring an electrical power flux rate of the electrical power storage apparatus via an artificial intelligence application executing on at least one processor; and managing, via the artificial intelligence application, charging and discharging of the electrical power storage apparatus based on the monitoring of the electrical power flux rate.

12. The method of claim 11, wherein the electrical power storage apparatus and the fossil fuel-fired power generation unit are disposed within the steam-based power plant.

13. The method of claim 11, wherein the electrical power storage apparatus is electrically coupled to an additional fossil fuel-fired power generation unit.

14. The method of claim 11, wherein the component of the fossil fuel-fired power generation unit is at least one of:

a coal pulverizer;

a fuel classifier;

a fan;

a water pump;

a heater; and a plasma igniter.

15. The method of claim 11, wherein the period of electrical power shortage includes at least one of:

a ramp-up of the fossil fuel-fired power generation unit;

a peak-demand period of the fossil fuel-fired power generation unit; and a power fault of the electrical grid.

16. The method of claim 11, further comprising:

predicting, via the artificial intelligence application, future periods of surplus electrical power generation by the fossil fuel-fired power generation unit and/or future periods of electrical power shortage by the electrical power grid.

17. The method of claim 11, wherein the artificial intelligence application includes at least one of a neural network and a machine learning module or engine.

18. The method of claim 11, further comprising:

electrically communicating, via the artificial intelligence application, with at least one other processor disposed outside of the steam-based power plant in which the electrical power storage apparatus is disposed.

19. The method of claim 11, wherein the electrical power storage apparatus directly provides electrical power to the component of the fossil fuel-fired power generation unit.

20. The method of claim 11, further comprising:

monitoring, via the artificial intelligence application, an ability of the electrical power storage apparatus to efficiently charge and/or discharge; and scheduling, via the artificial intelligence application, predictive and/or preventative maintenance of the electrical power storage apparatus.

* * * * *